US009676508B2

(12) United States Patent
Devoy et al.

(10) Patent No.: US 9,676,508 B2
(45) Date of Patent: Jun. 13, 2017

(54) WITHIN BOTTLE AERATOR

(71) Applicant: MARS AERATOR LLC, Edgewater, MD (US)

(72) Inventors: Joseph Devoy, Edgewater, MD (US); Brian Whalen, Crownsville, MD (US)

(73) Assignee: Mars Aerator LLC, Edgewater, MD (US)

( * ) Notice: Subject to any disclaimer, the term of this patent is extended or adjusted under 35 U.S.C. 154(b) by 224 days.

(21) Appl. No.: 14/446,669

(22) Filed: Jul. 30, 2014

(65) Prior Publication Data

US 2016/0030898 A1 Feb. 4, 2016

Related U.S. Application Data

(63) Continuation of application No. 12/893,057, filed on Sep. 29, 2010, now Pat. No. 8,807,358.

(51) Int. Cl.

| | |
|---|---|
| ***B65D 1/02*** | (2006.01) |
| ***B01F 5/04*** | (2006.01) |
| ***B65D 51/16*** | (2006.01) |

(52) U.S. Cl.

CPC ..... *B65D 1/02* (2013.01); *B01F 5/0428* (2013.01); *B65D 51/1605* (2013.01); *B01F 2215/0072* (2013.01); *B65D 2501/0009* (2013.01)

(58) Field of Classification Search

CPC .... B01F 5/0428; B01F 3/0446; B01F 13/002; B01F 2215/0072; B65D 2501/0009; B65D 51/1605; B65D 1/02

See application file for complete search history.

(56) References Cited

U.S. PATENT DOCUMENTS 347,018 A * 8/1886 Ware ..... A61J 9/04 215/11.5
808,569 A * 12/1905 Norman ..... B65D 49/04 215/25

(Continued)

FOREIGN PATENT DOCUMENTS

DE 19652216 A1 * 8/1997 ..... B65D 25/48
DE 10018495 C1 * 10/2001 ..... B65D 25/40

*Primary Examiner* — Tri Mai

(74) *Attorney, Agent, or Firm* — David I. Roche; Baker & McKenzie LLP

(57) ABSTRACT

An in-bottle aerator for mixing the oxygen in the air with wine as the wine is poured from its bottle. The aerator has at least one air ingress channel extending from one end of the aerator to the other, allowing air into the bottle to displace wine exiting the bottle. Air mixing channels draw air from outside the bottle and direct that air to lateral channels that intersect a central flow channel extending from one end of the bottle to another. The air mixing and air ingress channels are preferably arranged to allow the user to pour and aerate wine at the same time and with the bottle in any orientation about its axis. The aerator may be a separately formed component that can be inserted into the bottle by the bottle manufacturer, by a wine bottler or by an enduser. Alternatively, the aerator may be wholly or partly formed as part of the neck of the bottle. A completely and integrally formed aerator may be formed as a part of a plastic wine bottle. For plastic or glass wine bottles, aeration channels may be formed on the internal surface of the neck of the bottle, and an insert can be used to complete the within bottle aerator by the insertion (by the bottle manufacturer, by a wine bottler or by an enduser) of an aerator component having additional channels formed therein.

7 Claims, 4 Drawing Sheets

(56) References Cited

U.S. PATENT DOCUMENTS

| | | | | | |
|---|---|---|---|---|---|
| 824,122 | A * | 6/1906 | Jones | B65D 49/04 | 215/25 |
| 903,467 | A * | 11/1908 | Glines | B65D 47/18 | 222/420 |
| 1,436,645 | A * | 11/1922 | Brown | B65D 47/18 | 215/309 |
| 1,436,708 | A * | 11/1922 | Goebel | B65D 47/06 | 215/309 |
| 2,497,134 | A * | 2/1950 | Muenze | B65D 47/06 | 222/478 |
| 2,992,761 | A * | 7/1961 | Sommers, Sr. | E02D 7/24 | 222/479 |
| 4,398,652 | A * | 8/1983 | Ueda | B65D 17/502 | 222/1 |
| 8,807,358 | B2 * | 8/2014 | Devoy | B01F 3/0446 | 215/309 |
| 2004/0035894 | A1 * | 2/2004 | Gobbini | B65D 47/32 | 222/479 |
| 2012/0074172 | A1 * | 3/2012 | Federighi | B01F 3/0446 | 222/190 |

* cited by examiner

WITHIN BOTTLE AERATOR

This is a continuation of application Ser. No. 12/893,057, filed 29 Sep. 2010, which is incorporated herein by reference.

BACKGROUND OF THE INVENTION

Field of the Invention

This invention pertains generally to the aeration of liquids where the mixture of air, or subcomponents (e.g., oxygen), with fluid exiting a bottle improves the ratio of air contacting the fluid and is advantageous to the utility of the fluid. In particular, this invention pertains to a 'within bottle' article to aerate wine and similar fluids to enhance the taste, as well as its design, manufacture and usefulness.

Description of the Related Art

Multiple wine aeration techniques have been in use for many years. Aeration techniques include opening a bottle and letting it sit for an extended period of time, also known as allowing a bottle to 'breath'. In addition, swirling the wine in a glass, decanting a wine down the inside surface(s) of a decanter as in U.S. Pat. No. 5,579,962, or pouring wine through an injection-style aerator (hand held as in U.S. Pat. No. 7,614,614 or 'bottle opening pourer' U.S. Pat. No. 6,568,660). Still other ways to create turbulent flow into a liquid is through sieve-style funnels, such as in U.S. Pat. No. 6,568,660.

In any case, the wine must be able to exit the bottle, be mixed with air, and be poured into a glass (or similar reservoir) at an acceptable rate to introduce enough air to the fluid to make a palatable difference to the wine, and an efficient pour into the glass. This is particularly useful for 'young' wines and heavier red wines such as Cabernet, Merlot, Shiraz and other similar styles or mixtures.

SUMMARY OF THE INVENTION

One objective of this invention is to provide an insert, for any extant bottle, that aerates wine and is inserted into the neck of the bottle during either a) the bottling process or b) after the bottle is opened (either cork or screw cap) such that the insert becomes an integral part of the bottle and allows air into the bottle to displace fluid removed and via turbulent flow or Venturi effect, aerates the wine coming out of the bottle.

Another objective is to provide wineries, and other related industries and bottling specialists, with a device and method to aerate wine, and other fluids that can benefit from aeration, in a manner that does not require an exterior-to-the-bottle device. This applies to the wine industry in sectors such as wineries, bottlers, restaurateurs and wine consumers, but may also have applications in the medical, chemistry and bio-engineering applications. As an example, wineries can specify the insertion of a within bottle aerator as described herein during the bottling process to ensure their product is always aerated for the best taste. Additionally, restaurants can insert a within bottle aerator as described herein into any bottle they have prior to serving, and leave it at the table.

Yet another objective is to provide the users of this invention with a very-low cost aeration devices that could be thrown away after use. It would also be a very effective substitute to more expensive hand-held or bottle opening pourer.

Figures 1A, 1B, 1C:
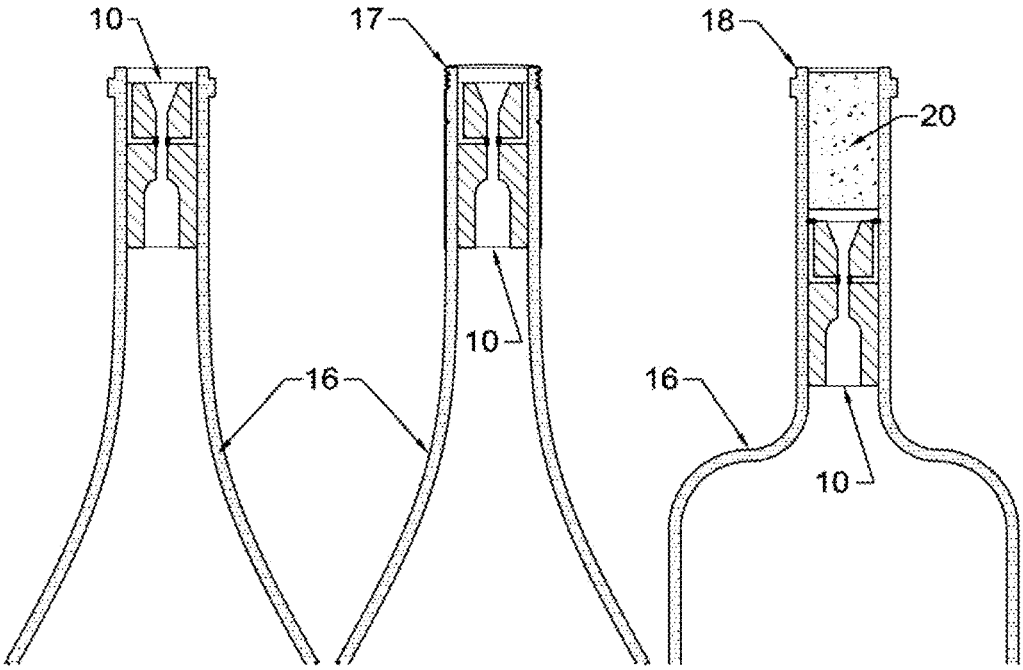
FIG. 1*a* shows a 'Within Bottle Aerator' inserted inside a wine bottle towards the top of the bottle neck.
FIG. 1*b* shows a 'Within Bottle Aerator' inserted into a screw cap bottle.
FIG. 1*c* shows a 'Within Bottle Aerator' inserted under a corked bottle.
Figures 2A, 2B:
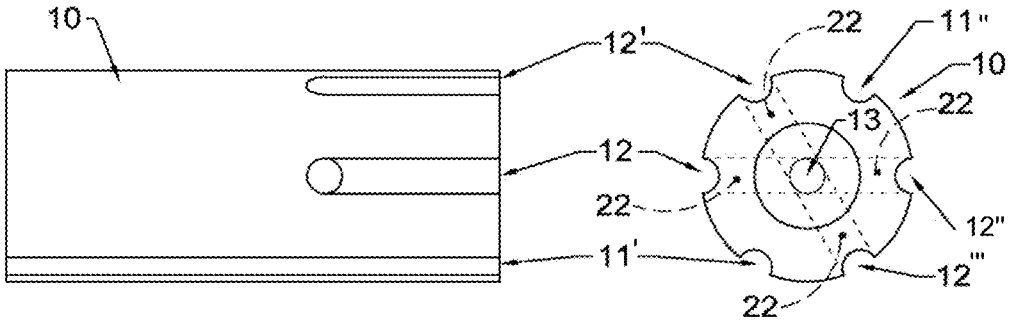
FIG. 2*a* shows a side view of a 'Within Bottle Aerator' device.
FIG. 2*b* shows the top-of-bottle end view of a 'Within Bottle Aerator' device.

Suffixes in the form of lower case letters ("a", "b", "c" etc.) are used with the same referenced numerals to identify structures that are similar to each other in various embodiments. In addition, prime indicators (i.e., single prime, double prime or triple prime) have been added to reference numerals to indicate substantially the same structure at different locations.

DETAILED DESCRIPTION

The aerator 10 is an insert, for any extant bottle 16, that aerates wine and is able to be inserted into the neck of the bottle (FIG. 4) during either a) the bottling process or b) after the bottle is opened (either cork or screw cap), such that the insert becomes an integral part of the bottle and allows air into the bottle to displace fluid removed and via turbulent flow or Venturi effect, aerating the wine coming out of the bottle. Much like a screw cap offering a superior seal to traditional corks, the aerator described herein offers a superior aeration technique to other aerators, since it would be integral to the bottle.

FIGS. 1*a* and 1*c* show a bottle 16 with an unthreaded neck 18, which is suitable for and commonly used with a natural or synthetic cork 20. FIG. 1*b* show an externally threaded neck 17, which is used with a screw-on cap.

Figure 3A:
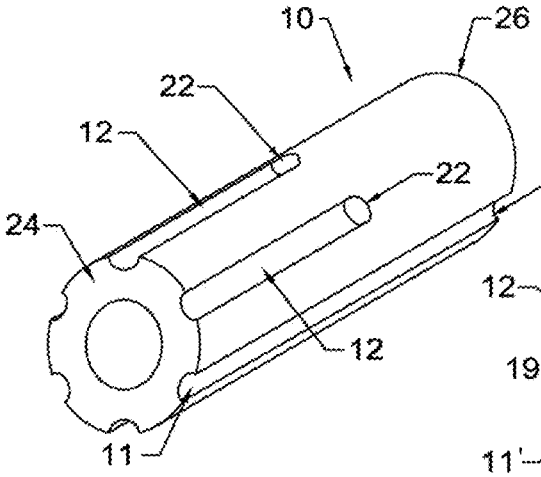
FIG. 3*a* shows a perspective view of a 'Within Bottle Aerator' device.
Figure 3B:
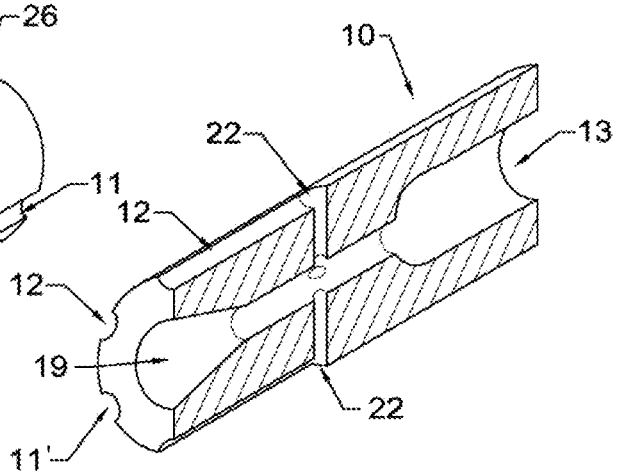
FIG. 3*b* depicts perspective sectional view of a 'Within Bottle Aerator' functions.

The aerator described herein could be utilized in several ways: 1) during the bottling process, where it would be inserted under a cork (FIG. 1*c*), or 2) during the bottling process, where it would be inserted under the screw cap of a bottle of wine like the one shown in FIG. 1*b*, or 3) after a bottle is opened, where a retailer or consumer could insert the aerator 10 into the neck of the bottle by hand or tool. In the case where the aerator 10 is inserted by a retailer or customer, the bottle could be the unthreaded or threaded type.

The aerator described herein may be scaled to any bottle neck diameter, and can be used for any type of bottle without redesign of the bottle. Since it can be relatively small (about the size of a wine bottle cork), it should not cause a loss of product volume in the bottle. Furthermore, the aerator described herein can be designed so as not to disturb the factory seal of the bottle. For those consumers that utilize a vacuum pump sealer (of the type shown in U.S. Pat. No. 602,777), the aerator disclosed herein would not prevent the use of such inserts, which would allow an opened bottle of wine to last longer after opening.

Figure 4:
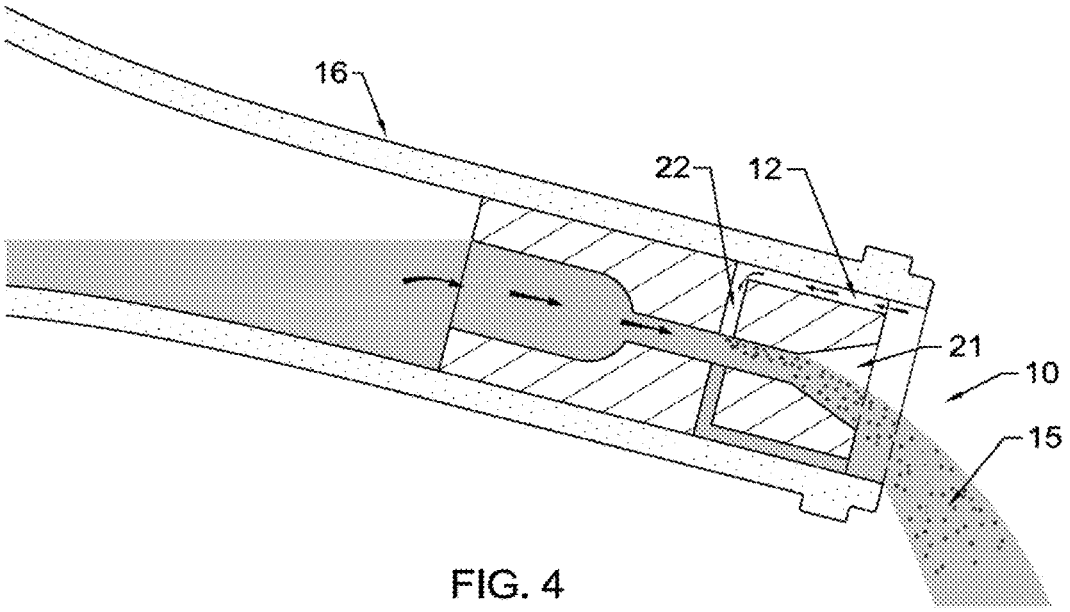
FIG. 4 provides sectional view of a 'Within Bottle Aerator' device in a bottle with wine and air flow.

The aerator disclosed herein works by mixing air and wine flow. The central flow channel 13, which has a generally flared section 21 at its proximal (upper) end 24, with a smaller and larger diameter at the opposite ends of the flared section 21. The enlarged opening at the proximal end allows the wine 15 to flow faster through the smaller diameter section of the flow channel 13. As the wine passes through the narrowest part of the flow channel 13, its velocity increases causing the pressure in the wine to decrease. The decrease in pressure of the wine results in air being sucked through the aeration channels 12 and into the lateral channels 22 to equalize the pressure (FIG. 4). This is an example of the Venturi effect, used in multiple applications and patents including U.S. Pat. No. 7,614,614. Air mixes with the wine and allows a much increased surface area of wine to come into contact with the oxygen in the air, which brings out more flavor in many wines, and makes wines generally more palatable The aerator disclosed herein is a device that can offer several improvements over conventional bottling practices. Since the aerator is actually inserted into the neck of the bottle (FIG. 4), a user can pour an aerated glass of wine with one hand, unlike a hand-held aerator. That allows the pourer to grasp the glass or other items with the second hand; critical for restaurant wait staff, flight attendants, and many consumers. The aerator described herein aerates the wine as it comes out of the bottle (FIG. 4), offering an immediate palatable improvement to young wines, or heavy red wines. This is an improvement over passive methods that require significant time to pass for the bottle to 'breath', or swirling the wine several minutes. The aerator described herein is less expensive than the 'bottle opening pourers' that are re-usable, but which must be inserted into the top of the bottle after opening. And the risk of such bottle opening pourers to accidentally become dislodged while pouring does not exist with the aerator described herein. The aerator described herein does not require that the user pour the wine into another reservoir before serving the wine, as is required when using a decanter, and is much less expensive and quicker than a decanter. FIG. 2*a*, FIG. 2*b*, FIG. 3*a*, FIG. 3*b* show the various flow channels in the exemplary embodiment of the aerator 10. The aerator 10 has a central flow channel 13 extending from the proximal end 24 to the distal end 26. Air to be mixed with wine is drawn into air mixing channels 12 that are formed in the exterior surface of the aerator 10 and extend from the proximal end 24 to about midway between the proximal and distal ends. The air mixing channels 12 intersect and are in fluid communication with transverse channels 22 which, in turn, intersect, and are in fluid communication with the central flow channel 13. An air mixing channel 12 and a transverse channel 22 together form an aeration channel that bring air from the atmosphere to a point in the central flow channel that is between the distal end 26 and the proximal end 24 of the aerator 10.

In the particular embodiment shown in FIGS. 2*a*, 2*b*, 3*a*, and 3*b*, the aerator 10 includes two sets of air mixing channels 12 and two sets of transverse channels 22. In each case the air mixing channel 12 extends from the proximal end 24, where it has access to ambient atmosphere, to a point along the length of the aerator where it intersects a transverse channel 22 that connects the air mixing channel 12 to the central flow channel 13, so that air can be drawn from the atmosphere and mixed with the wine as the wine moves toward the proximal end 24 and the flared portion 21 of the flow channel 13.

In order for the contents to exit the bottle 16, air needs to enter the bottle. Therefore, the aerator 10 includes air ingress channels 11 which extend along the exterior of the aerator 10 from the along the full length of the aerator 10 from the proximal end 24 to the distal end 26. The air ingress channels 11 allow air to be sucked into the bottle to displace the wine flowing out of the bottle. To allow the bottle to be tilted and rotated in any direction and still pour properly, the aerator 10 has two air ingress channels 11, one on each generally opposite sides of the aerator, and in this embodiment the air ingress channels 11 are diametrically opposite each other.

Figures 5A, 5B, 5C, 5D, 5E:
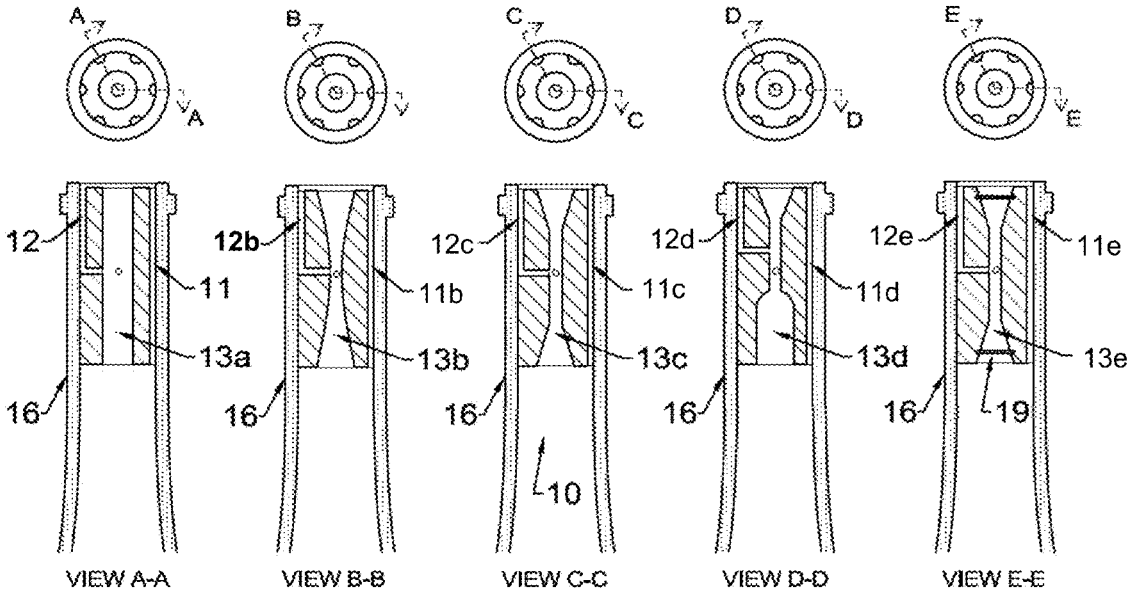
FIG. 5A depicts an end view over a section view taken along line A-A.
FIG. 5B depicts an end view over a section view of taken along line B-B.
FIG. 5C depicts an end view over a section view taken along line C-C.
FIG. 5D depicts an end view over a section view taken along line D-D.
FIG. 5E depicts an end view over a section view taken along line E-E.
Figures 6A, 6B, 6C, 6D:
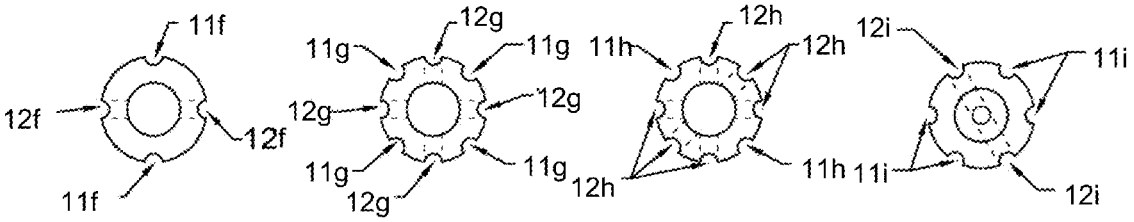
FIGS. 6A through 6D are end views of alternative embodiments showing alternative arrangements of air ingress, air mixing and aeration channels.

Several designs of the aerator are possible. The flow channel 13 may be of various shapes. For example, the flow channel 13*a* of the aerator shown in FIG. 5A is generally a simply cylindrical shape. The flow channel 13*b* in FIG. 5B has a continuously curved hourglass shape. The flow channels 13*b* and 13*e* in FIGS. 5C and 5E, respectively, have two flared sections (one at each end) with a narrow channel in between. The flow channel 13*d* in FIG. 5D has a reverse cup at its distal end and a cone section at its proximal end. Each aerator preferably has a plurality of air ingress, transverse, and air mixing channels, with the air ingress channels disposed on generally opposite sides of the aerator. This allows the bottle to be rotated any direction or angle and still function properly. Additionally, as shown in FIG. 5E, a mesh screen material 19, or a perforated disc can be inserted into the aerator to provide a more turbulent flow (FIG. 5*e*), which would also break up the air bubble to increase wine to air surface area as the wine exits the bottle.

While the air ingress channels 11 and air mixing channels 12 are shown as half-pipes formed in the exterior surface of the aerator 10, they could be disposed within the body of the aerator. Furthermore, in order to allow the bottle to be used in any orientation about its axis, the arrangement of channels shown in FIGS. 2*a*, 2*b*, 3*a*, and 3*b* includes two air ingress channels 11 diametrically opposite each other. However, those channels could be designed and oriented differently, such as including three or another number of such channels, and disposing them at various positions about the aerator such that they do not intersect the central flow channel. Similarly, the air ingress channels 12 and transverse channels 22 could be designed and arranged in a manner different from what is shown in FIGS. 2*a*, 2*b*, 3*a*, and 3*b*. While four each of the air ingress channels 12 and transverse channels 22 are shown, there could be a larger or smaller number of such channels and their diameters could be varied from what is shown, to increase or decrease the amount of air to be mixed. Similarly, the size and shape of the central flow channel could be varied.

FIGS. 6A-D show aerators with different arrangement and numbers of channels 11 and 12. The aerator could be made of multiple materials that can be molded or shaped with the required design attributes, yet be made pliable enough to be slightly compressed as it is inserted into the neck of a wine bottle. While it is preferable that the aerator extend fully or entirely into the bottle, some portion may be left extending from the bottle, in some cases, for example to facilitate removal of the aerator for recycling or other purposes. The best materials are those that are "food grade" and do not exude any residual vapor, oils or other byproducts of manufacturing or natural causes, that may change the taste of the wine. Candidate materials include artificial foamed cork (See U.S. Pat. No. 5,328,937), food grade rubber (i.e., approved for use with food products), as well as natural cork, agglomerated cork and certain food grade plastics or Teflon. Any mesh or screen inserts to create turbulent flow 19 should be made from higher quality plastic or stainless steel approved for use with food.

Figure 7A:
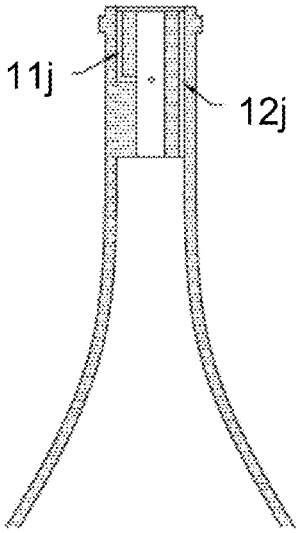
FIGS. 7A-C show three examples of a within bottle aerator molded as part of a bottle.
Figure 7B:
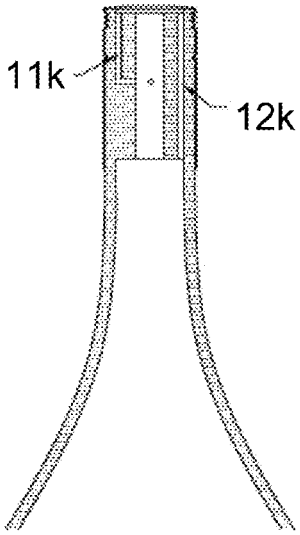
Figure 7C:
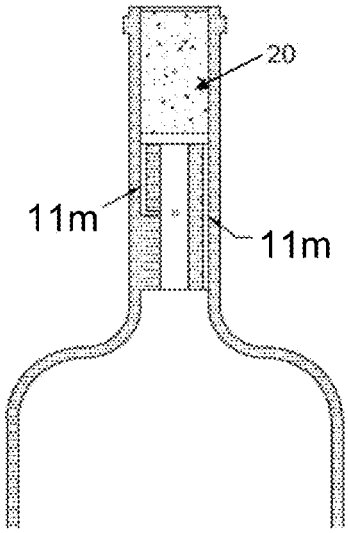

FIGS. 7A-C show examples of a within bottle aerator manufactured as a part of a bottle. With the advance of plastic bottle technology has come the opportunity to design a plastic bottle in which the formation of the aerator may be included as part of the plastic bottle molding process. In a similar manner, in the case of a glass bottle, grooves that form pathways for the ingress of air into or egress of wine from the bottle may be molded or otherwise formed into the inner walls of the neck of the glass bottle. In this case the aerator may still be of a different material than the bottle and inserted after the bottle is formed (by the bottle manufacturer, a wine bottler or by an enduser), but an aerator insert for a bottle with channels formed on its interior walls may have fewer channels than an aerator for use with a bottle with smooth interior walls. In FIG. 7A, the bottle has an aerator formed as part of the bottle neck having a external rib and no threads. In FIG. 7B, the bottle neck is externally threaded to accommodate a threaded overcap. In FIG. 7C, like the bottle of 7A, the bottle has an aerator formed as part of the bottle neck, but the aerator is recessed to allow a cork (real or synthetic) to be used as a closure. In all of FIGS. 7A-C, the aerator has air ingress channels 11 and air mixing channels 12. It should be noted that, while the channels 11 are shown as have a 90 degree bend the channels 11 could be otherwise configured, e.g., they could on a slant and in the form of a straight line or curved, depending on the manufacturing technique used. As noted above the air mixing channels 12 could be formed into the interior walls of the bottle neck, and a separate aeration piece (with only air ingress channels 11 formed therein) could be inserted after the bottle is formed, either by the bottle maker, by the wine bottler, or by an end user.

Although the inventions described and claimed herein (collectively sometimes referred to herein as the "invention"—singular) have been described in considerable detail with reference to certain preferred embodiments, one skilled in the art will appreciate that the inventions described and claimed herein can be practiced by other than the preferred embodiments, which have been presented for purposes of illustration and not of limitation. Therefore, the spirit and scope of the appended claims should not be limited to the description of the preferred embodiments contained herein.

We claim:

1. An aerator for use substantially within the neck of a bottle comprising:

a body having a central channel for egress of liquid from the bottle, the body having a proximal end and a distal end, the body being free of radially extending flanges and being without substantial changes in its diameter from the proximal end to the distal end, and a plurality of outer channels for ingress of air into the bottle, said plurality of channels each extending along an exterior surface of the body from substantially one end of the body to substantially the other end of the body, and at least one aeration channel establishing fluid communication between the central channel and an area exterior of the bottle, the at least one aeration channel being comprised of a first section extending in a generally axial direction and being in fluid communication with area exterior to the bottle and a second section extending in a generally transverse direction and establishing fluid communication between the first section and the central channel, and the aerator being formed with the neck of the bottle and integrally connected therewith.

2. An aerator in accordance with claim 1 wherein the aerator is made from the same material as said bottle.

3. An aerator in accordance with claim 1 and further comprising:

the aerator being comprised of a resilient material selected from the group consisting of food grade plastic and glass.

4. An aerator in accordance with claim 1 which further comprises:

each outer channel being disposed radially outwardly of said central channel, and extending from the distal end to the proximal end.

5. An aerator in accordance with claim 1 and further comprising:

at least two aeration channels having first sections disposed on generally diametrically opposite sides of the central channel.

6. An aerator in accordance with claim 1 and further comprising:

the at least one aeration channel comprising two aeration channels, each one of the aeration channels having a first section disposed on generally diametrically opposite sides of the central channel.

7. An aerator in accordance with claim 1 and further comprising:

the aerator being comprised of a synthetic material.

* * * * *